US007017904B2

(12) United States Patent
Ohara et al.

(10) Patent No.: US 7,017,904 B2
(45) **Date of Patent: *Mar. 28, 2006**

(54) TOKEN-OPERATED GAME MACHINE

(75) Inventors: Toshiya Ohara, Yamato (JP); Kiyotaka Maeno, Yokohama (JP); Hideyuki Kaneko, Yokohama (JP); Keizo Wada, Kawasaki (JP)

(73) Assignee: Namco Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/880,535

(22) Filed: Jul. 1, 2004

(65) Prior Publication Data

US 2005/0046106 A1 Mar. 3, 2005

Related U.S. Application Data

(63) Continuation-in-part of application No. 10/285,531, filed on Nov. 1, 2002, now Pat. No. 6,769,687.

(51) Int. Cl.
*A63F 9/00* (2006.01)

(52) U.S. Cl. ..... 273/138.1; 463/20

(58) Field of Classification Search ..... 273/138.1; 463/20, 46

See application file for complete search history.

(56) References Cited

U.S. PATENT DOCUMENTS

| | | | | |
|---|---|---|---|---|
| 1,607,796 | A | 11/1926 | Mellor | |
| 4,487,414 | A * | 12/1984 | Karkkainen et al. | 273/371 |
| 4,743,024 | A * | 5/1988 | Helm et al. | 273/143 R |
| 4,759,551 | A | 7/1988 | Crompton | |
| 4,821,863 | A * | 4/1989 | Okada | 194/344 |
| 4,846,333 | A | 7/1989 | Kissick | |
| 4,926,996 | A * | 5/1990 | Eglise et al. | 194/212 |
| 4,948,133 | A * | 8/1990 | Helm et al. | 273/124 A |
| 5,044,483 | A | 9/1991 | Stefan | |
| 5,580,310 | A * | 12/1996 | Orus et al. | 463/16 |
| 5,613,910 | A * | 3/1997 | Hamano | 463/19 |
| 5,884,752 | A | 3/1999 | Osborn et al. | |
| 6,334,612 | B1 | 1/2002 | Wurz et al. | |
| 6,641,137 | B1 * | 11/2003 | Sines et al. | 273/121 B |
| 6,676,514 | B1 * | 1/2004 | Kusuda et al. | 463/24 |
| 6,769,687 | B1 * | 8/2004 | Ohara et al. | 273/138.1 |

FOREIGN PATENT DOCUMENTS

| | | |
|---|---|---|
| JP | U 31-11523 | 7/1956 |
| JP | U 3-779 | 1/1991 |
| JP | A-9-56924 | 3/1997 |
| JP | A 9-056924 | 3/1997 |
| JP | A-9-313732 | 12/1997 |
| JP | A-2000-107346 | 4/2000 |
| JP | A 2000-288234 | 10/2000 |
| JP | A-2001-29643 | 2/2001 |
| JP | A 2001-029643 | 2/2001 |
| JP | A 2001-29643 | 2/2001 |
| WO | WO 88/03299 | 5/1988 |

* cited by examiner

*Primary Examiner*—Eugene Kim
*Assistant Examiner*—D Collins
(74) *Attorney, Agent, or Firm*—Oliff & Berridge, PLC

(57) ABSTRACT

A token-operated game machine enabling continuous insertion of tokens without stop of a game such that a player can enjoy the game without troublesome motions such as crouching or reaching out. A game is played by inserting a token into a token entrance, and a token is paid out based on the game result. The token-operated game machine 10 has a token receiving section for receiving paid-out tokens, and a entryway 40 for slidably moving tokens from the token receiving section to the token entrance.

16 Claims, 4 Drawing Sheets

TOKEN-OPERATED GAME MACHINE

This is a Continuation of application Ser. No. 10/285,531 filed Nov. 1, 2002 now U.S. Pat. No. 6,769,687. The entire disclosure of the prior application is hereby incorporated by reference herein in its entirety.

Japanese Patent Application No. 2001-345068, filed on Nov. 9, 2001, is hereby incorporated by reference in its entirety.

BACKGROUND OF THE INVENTION

The present invention relates to a token-operated game machine.

There is known a token pusher game machine as one of token-operated game machines.

Such a token pusher game machine is known in the art, for example, from Japanese Patent Laid-Open Application No. 2001-29643.

The token pusher game machine generally includes a housing, a playfield on which a number of tokens are placed, a pusher moves forward and backward on the playfield, and a balloting board disposed at the upper back of the housing.

In this conventional machine, a token entrance is provided at the top of the housing. A token inserted through the token entrance passes over the balloting board under its own weight. After the token has been balloted by the balloting board, it falls onto the playfield. The token on the playfield is moved by the pusher toward the edge of the playfield and finally dropped under its own weight into a payout port provided at the bottom of the housing.

The game in such a token pusher game machine was troublesome since the token entrance and payout port are respectively located on the top and bottom of the housing. In such an arrangement, a player has to crouch to take tokens from the lower payout port and then stand up or reach out to insert tokens into the entrance. Such operations are required to be repeated during the game, causing the game to be halted, and it is too much bother for the player to repeat such motions.

Furthermore, since the player has to make sure of the entrance position, he or she is forced to look away from the balloting board, causing the game to be halted again.

BRIEF SUMMARY OF THE INVENTION (1) According to a first aspect of the present invention, there is provided a token-operated game machine for playing a game by inserting a token to a token entrance and paying out a token based on the game result, the token-operated game machine comprising:

a token receiving section for receiving paid-out tokens; and an entryway for slidably moving tokens from the token receiving section to the token entrance.

(2) According to a second aspect of the present invention, there is provided a token-operated game machine for playing a game based on the position of a token which passes over a playing board and paying out a token based on the game result, the token-operated game machine comprising:

a token receiving section for receiving paid-out tokens; and an entryway for slidably moving tokens from the token receiving section to the token entrance.

(3) According to a third aspect of the present invention, there is provided a token-operated game machine in which a token is inserted through a token entrance to drop a token from a playfield and pay out a token, the token-operated game machine comprising:

a token receiving section for receiving paid-out tokens; and an entryway for slidably moving tokens from the token receiving section to the token entrance.

DETAILED DESCRIPTION OF THE EMBODIMENT

Figure 1:
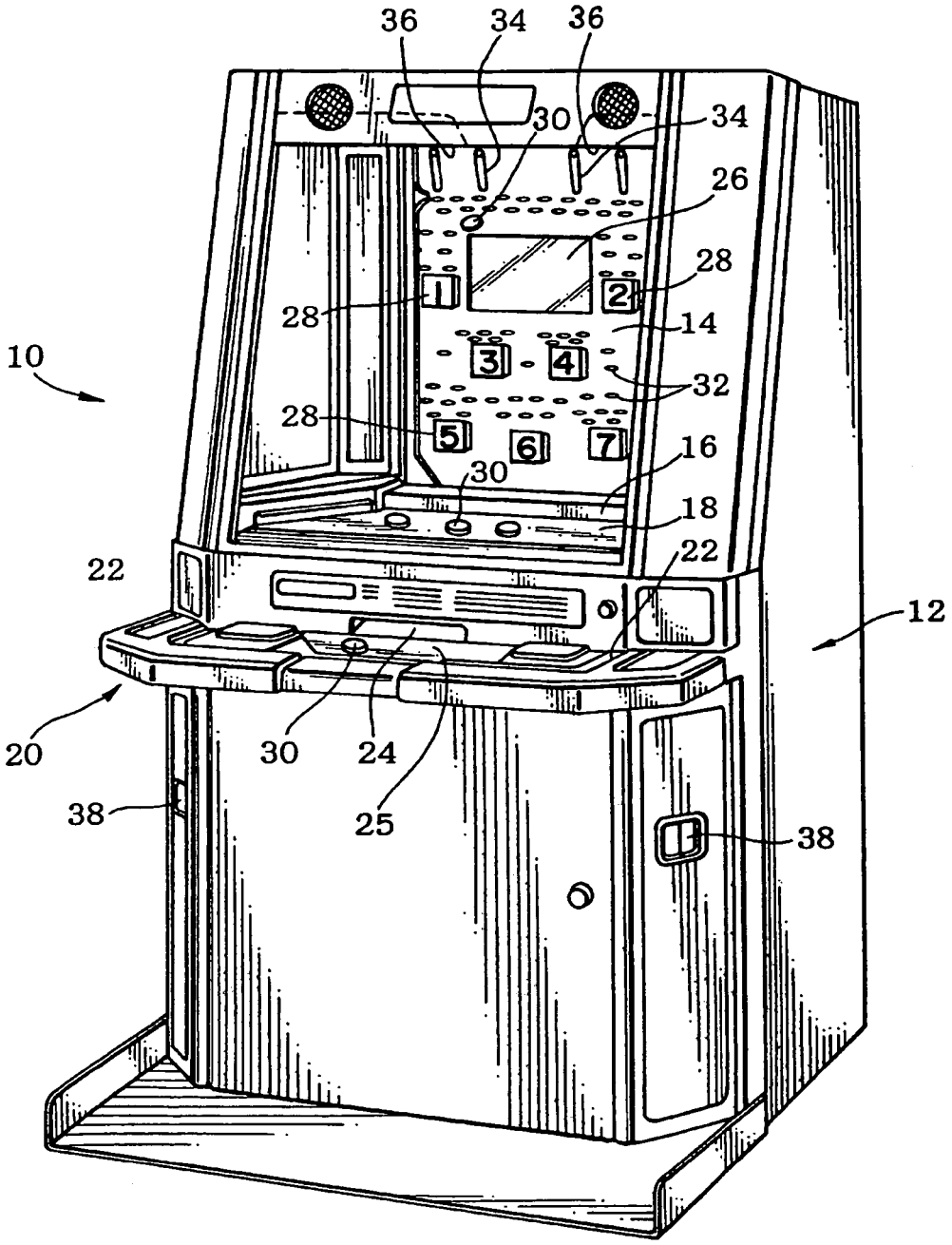
FIG. 1 is a perspective front view of a token-operated game machine according to one embodiment of the present invention.

Embodiments of the present invention will now be described in detail with reference to the drawings.

Note that the embodiments described below do not in any way limit the scope of the invention defined by the claims laid out herein. Similarly, all the elements of the embodiments described below should not be taken as essential requirements of the present invention.

(1) According to one embodiment of the present invention, there is provided a token-operated game machine for playing a game by inserting a token to a token entrance and paying out a token based on the game result, the token-operated game machine comprising:

a token receiving section for receiving paid-out tokens; and an entryway for slidably moving tokens from the token receiving section to the token entrance.

According to this embodiment of the token-operated game machine, a game is played by inserting a token into a token entrance and a token is paid out based on the game result. By providing an entryway on which a token can be slid from the token receiving section to the token entrance, a player can enjoy the game without any troublesome motions such as crouching or reaching out. Moreover, tokens can be continuously inserted from the token receiving section to the token entrance, so that a player can enjoy the game without stop of the game.

(2) According to one embodiment of the present invention, there is provided a token-operated game machine for playing a game based on the position of a token which passes over a playing board and paying out a token based on the game result, the token-operated game machine comprising:

a token receiving section for receiving paid-out tokens; and an entryway for slidably moving tokens from the token receiving section to the token entrance.

According to this embodiment of the token-operated game machine, a game is played based on the position of a token which passes over a playing board, and a token is paid out based on the game result. By providing an entryway on which a token can be slid from the token receiving section to the token entrance, a player can enjoy the game without any troublesome motions such as crouching or reaching out. Moreover, tokens can be continuously inserted from the token receiving section to the token entrance, so that a player can enjoy the game without stop of the game.

(3) According to one embodiment of the present invention, there is provided a token-operated game machine in which a token is inserted through a token entrance to drop a token from a playfield and pay out a token, the token-operated game machine comprising:

a token receiving section for receiving paid-out tokens; and an entryway for slidably moving tokens from the token receiving section to the token entrance.

According to this embodiment of the token-operated game machine, a token is inserted through the token entrance, and a token is dropped from the playfield to be paid out. A player can enjoy the game without any troublesome motions such as crouching or reaching out. Moreover, tokens can be continuously inserted from the token receiving section to the token entrance, so that a player can enjoy the game without stop of the game.

(4) In these embodiments, the token-operated game machine may further comprise a paying chute for sending a token dropped from the playfield to the token receiving section.

In this configuration, tokens dropped from the playfield can be sent to the token receiving section through the paying chute under their own weights.

(5) In this case, a dishonesty preventing means which prevents a dishonesty by a player may be provided in the paying chute.

In this configuration, since the paying chute has the dishonesty preventing means, a player cannot do any dishonesty such as to unduly drop tokens from the playfield by inserting his or her hand or any tool into the playfield through the paying chute, if the token receiving section is near the playfield.

(6) In these embodiments, the paying chute may be connected to a token withdrawing chute; and a switching means may be provided for switching between a path from the paying chute to the token receiving section and a path from the paying chute to the token withdrawing chute.

In this configuration, tokens are transferred into the token receiving section through the paying chute when a game is normally played. If any error occurs in the token-operated game machine or when the token-operated game machine is powered off, the switching means is actuated to open the token withdrawing chute so that tokens are guided to the token withdrawing chute, not to the token receiving section.

(7) The token-operated game machine may further comprise:

token detection means for detecting insertion of a token;

supply means for supplying a token to the playing board or the playfield when the token detection means detects insertion of a token; and a token entry chute through which an inserted token pass to the supply means.

In this configuration, a token inserted into the token entrance can be detected by the token detection means if the token entrance is disposed at a position lower than the playfield. In response to the insertion of a token, a new token can be reliably supplied from the token supplying means to the playfield.

(8) According to these embodiments, the token receiving section and the entryway may be integrally provided in an operating section in the housing; and the token entrance may be disposed adjacent to one end of the entryway.

In this configuration, the token receiving section and entryway are horizontally arranged in the operating section such that tokens can easily be moved from the token receiving section to the token entrance.

(9) According to these embodiments, the token receiving section may have a bowl-shaped configuration; and a surface of the entryway on which a token is moved may be on the same level with an inner surface of the token receiving section.

Thus, tokens can more easily be moved from the token receiving section to the token entrance.

FIGS. 1 to 4 show a token-operated game machine according to one embodiment of the present invention.

The token-operated game machine 10 is designed to be applied to a token pusher game. As shown in FIG. 1, the game machine has a housing 12, a playing board 14 disposed at the upper back of the housing 12, a playfield 18 on which tokens are placed, and a pusher plate 16 which is disposed on the playfield 18 and moves forward and backward under the playing board 14.

Moreover, an operating section 20 is provided substantially at the center front of the housing 12. The operating section 20 includes token entrances 22 and a token receiving section 25 for receiving tokens 30. A payout port 24 through which the tokens 30 are paid out to the token receiving section 25 is formed at the front of the housing 12, immediately above the operating section 20.

The playing board 14 includes a display 26, passage detection sections 28, pegs 32 for interfering with the movement of the tokens 30 toward the passage detection sections 28, and levers 34 for redirecting the tokens 30 discharged from discharge ports 36 located above both sides of the playing board 14.

Tokens 30 discharged from the discharge port 36 are redirected by the levers 34 and dropped while being interfered by the pegs 32. If the tokens 30 pass through the passage detection sections 28, sensors (not shown) within the respective passage detection sections 28 detect the passage of the tokens 30.

A game displayed on the display 26 proceeds on the basis of the positions of the passage detection sections 28 that have detected the passage of the tokens 30. In response to the results of the game, bonus tokens 30 are paid out from a paying hopper 74 within the housing 12 onto the playfield 18.

The tokens 30 dropped through the playing board 14 and the bonus tokens 30 paid out to the playfield 18 are then pushed and moved by the pusher plate 16 to be paid out through the payout port 24 into the token receiving section 25.

Note that the housing 12 further includes a token return port 38 at the side thereof below the operating section 20 to return the tokens 30 inserted from the token entrance 22.

Figure 2:
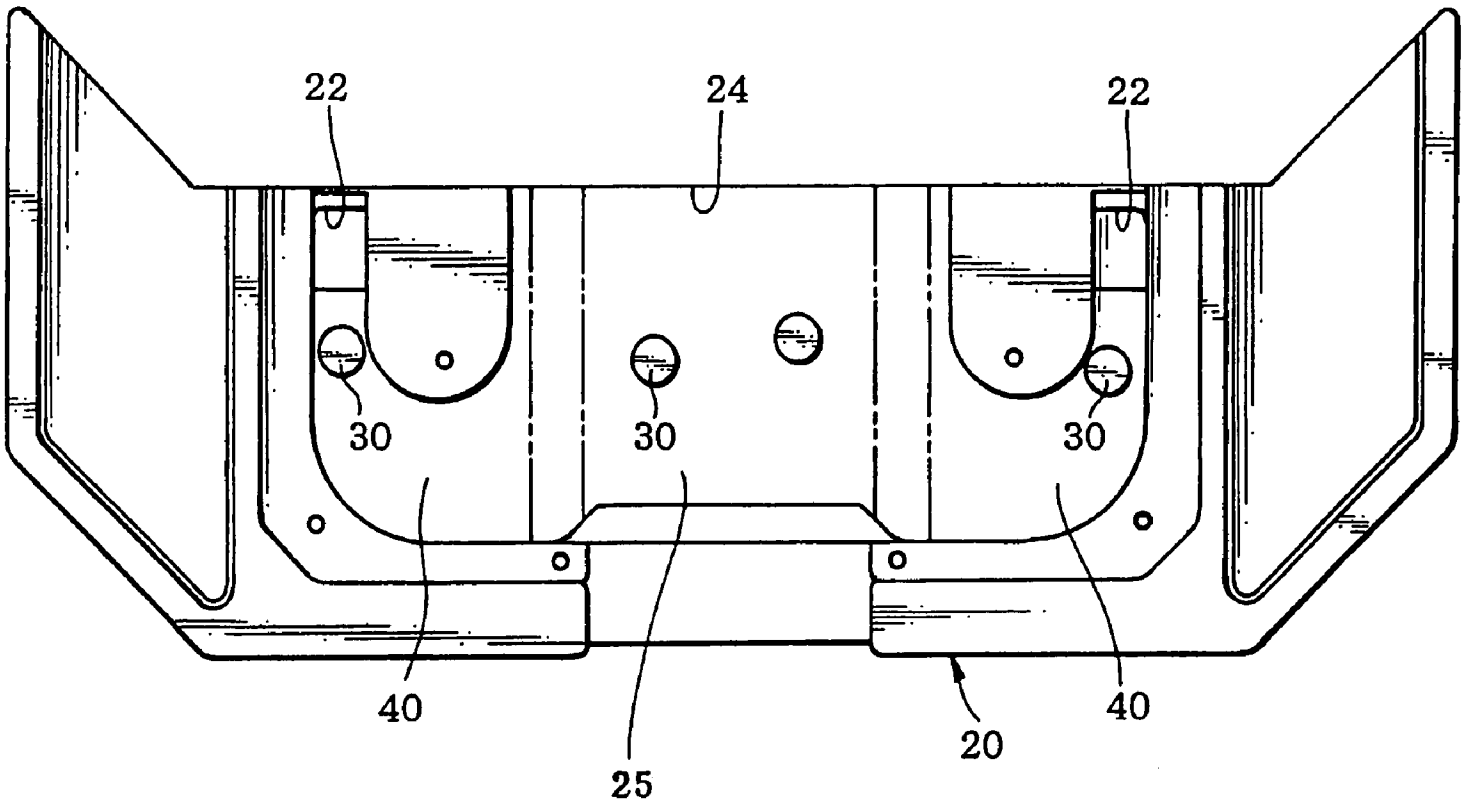
FIG. 2 is an enlarged plan view of an operating section of FIG. 1.

As shown in FIG. 2, the token entrance 22 is provided on each side part of the operating section 20, and the token receiving section is provided between these token entrances 22, so two players can play the game together while sharing the token receiving section 25.

Specifically, there are two token entrances 22 and one token receiving section 25 horizontally arranged in the operating section 20, and they are connected to each other by entryways 40 so that the tokens 30 can be slid over the entryways 40 from the token receiving section 25 to the respective token entrances 22.

Thus, the players can enjoy the game without troublesome motions such as crouching or reaching out their hands, because the token entrances 22 and the token receiving section 25 are horizontally arranged in the operating section 20.

Moreover, by connecting the token entrances 22 with the token receiving section 25 by the entryways 40, players can move the tokens 30 from the token receiving section 25 to the token entrances 22 while watching the playing board 14 without looking at the tokens 30. This prevents the game from being stopped, enabling to play the game continuously.

The players can move the tokens 30 without looking away from the playing board 14 since part of the bowl-shaped token receiving section 25 on the side of the entryways 40 is on the same level with the surface of the entryways 40 to ease the transfer of the tokens 30.

The operating section 20 is located at a position lower than the playfield 18, so that the tokens 30 dropped from the playfield 18 can be paid out through the payout port 24 under their own weights.

Figure 3:
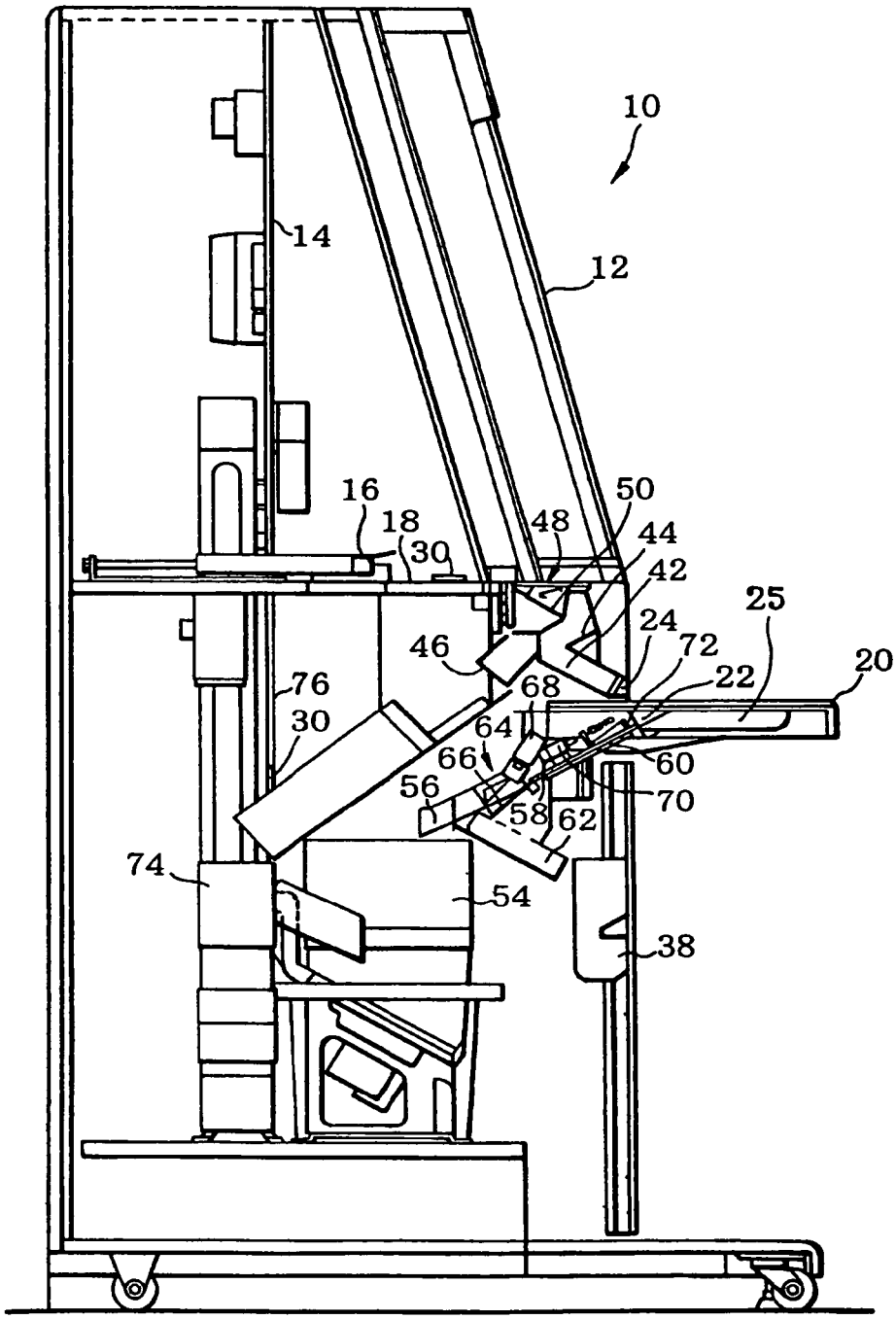
FIG. 3 is a vertical cross-section of the token-operated game machine shown in FIG. 1.
Figure 4:
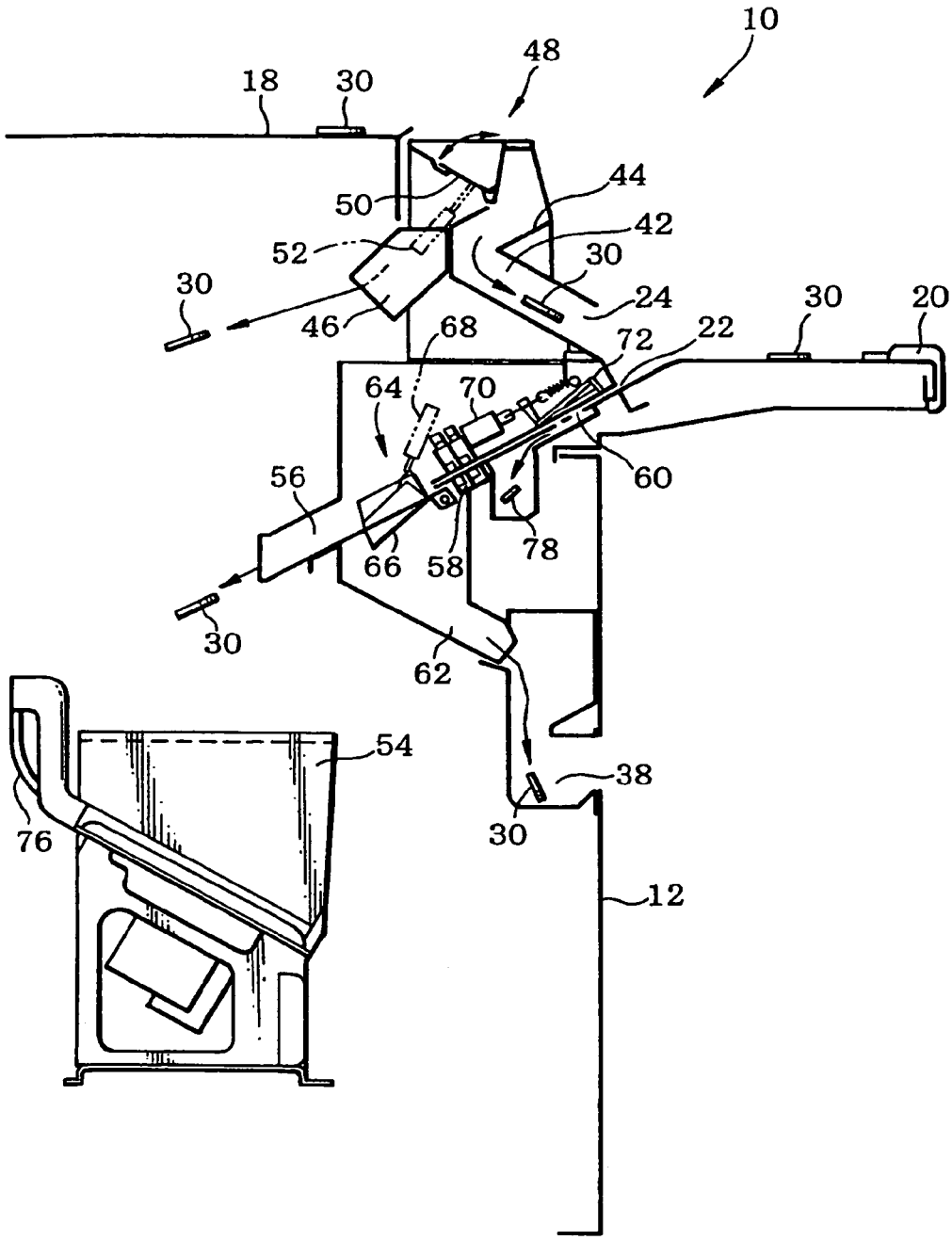
FIG. 4 is an enlarged sectional view illustrating the token entrance and payout port shown in FIG. 3.

The tokens 30 dropped from the playfield 18 pass through a paying chute 42 to be paid out from the payout port 24, as shown in FIGS. 3 and 4.

The paying chute 42 includes dishonesty preventing means 44 for preventing dishonesties by players.

The dishonesty preventing means 44 makes the paying chute 42 to have a zigzag configuration. This can prevent such dishonesty that a player unduly drops the tokens 30 from the playfield 18 by inserting a hand or tool through the paying chute 42.

The paying chute 42 is connected to a token withdrawing chute 46. A switching means 48 switches from the paying chute 42 to the token withdrawing chute 46 or vice versa.

The switching means 48 has a switching plate 50 movable between the paying chute 42 and the token withdrawing chute 46, and a solenoid 52 for actuating the switching plate 50. When the switching plate 50 is actuated to close the token withdrawing chute 46 and to open the paying chute 42 during the game play, the tokens 30 can be moved into the payout port. When any error occurs in the token-operated game machine or when the housing 12 is unduly vibrated or when the token-operated game machine is powered off, the switching plate 50 is then actuated to open the token withdrawing chute 46 and to close the paying chute 42. As a result, the tokens 30 can be moved into the paying hopper 74 within the housing 12 and will not be paid out through the payout port 24.

Each of the token entrances 22 is connected to a token entry chute 56 which transfers the tokens 30 to a hopper 54 located within the housing 12. The token entry chute 56 includes a pass sensor 58 as means for sensing the tokens.

If the pass sensor 58 detects the passage of the tokens 30, a predetermined number of additional tokens 30 are delivered from the hopper 54 to a token supply rail 76. The tokens 30 are sent to the discharge ports 36 from which they are dropped over the playing board 14.

If the token entrances 22 are disposed near the playfield 18, therefore, the tokens 30 inserted to the token entrances 22 are reliably detected by the pass sensors 58, and additional tokens can be delivered from the hopper 54 to the playing board 14 based on the number of the inserted tokens 30.

The token entry chute 56 also includes an irregular-shaped token eject slot 60. If a token having an irregular shape (e.g., small-sized token) 78 is inserted into any of the token entrances 22, the irregular-shaped token 78 is ejected through this irregular-shaped token eject slot 60.

The token entry chute 56 is also connected to a return chute 62 for returning the tokens 30 to the token return port 38 provided in the lower part of the housing 12. Another switching means 64 is provided to switch between the return chute 62 and the token entry chute 56.

The switching means 64 comprises a switching plate 66 for switching the token entry chute 56 to the return chute 62 or vice versa and a solenoid 68 for actuating the switching plate 66. When the switching plate 66 is actuated to open the token entry chute 56 and to close the return chute 62 during the game play, the tokens 30 inserted into the respective token entrances 22 can be moved into the hopper 54. When any error occurs in the token-operated game machine 10 or when the token-operated game machine 10 is powered off, the switching plate 66 is then actuated to close the token entry chute 56 and to open the return chute 62, thus returning the tokens 30 to the token return port 38.

The token entry chute 56 further includes a lock-out pin 72 actuatable by a solenoid 70. The lock-out pin 72 can be actuated by the solenoid 70 so that no token 30 will be inserted into the token entrances 22 when the game is not performed.

The present invention is not limited to the above-described embodiments, and various modifications can be made within the scope of the invention.

Although the illustrated embodiments have been described as to a token pusher game machine, the present invention may be applied to all the other token-operated game machines in which tokens will be paid based on the result of game in a playing board.

In the present invention, a token implies a token-shaped playing medium, and a coin is one form of the token-shaped playing medium.

The dishonesty preventing means is not limited to the zigzag shape of the paying chute, but may be replaced by the switching plate located in the paying chute. Alternatively, the dishonesty preventing means may be omitted if a sufficient distance can be secured between each of the payout ports and the playfield.

Although the embodiments have been described as to the tokens dropped from the playfield and paid out through the payout port under their own weights, the number of tokens dropped from the playfield may be counted such that additional tokens are paid from the token-operated game machine based on the number of dropped tokens.

The pass sensor may be replaced by any one of various other forms such as limit switches.

What is claimed is:

1. A token-operated game machine for playing a game by inserting a token to a token entrance and paying out a token based on the game result, the token-operated game machine comprising:

a token receiving section; and an entryway for slidably moving tokens from the token receiving section to the token entrance, wherein the token entrance and the entryway are provided in an operating section of the housing and the token entrance is disposed adjacent to one end of the entryway.

2. The token-operated game machine as defined in claim 1, wherein the token receiving section and the entryway are integrally provided in the operating section of the housing; and wherein the token entrance is disposed adjacent to one end of the entryway.

3. The token-operated game machine as defined in claim 1, wherein the token receiving section has a bowl-shaped configuration; and wherein a surface of the entryway on which a token is moved is on the same level with an inner surface of the token receiving section.

4. A token-operated game machine for playing a game based on the position of a token which passes over a playing board and paying out a token based on the game result, the token-operated game machine comprising:

a token receiving section; and an entryway for slidably moving tokens from the token receiving section to the token entrance, wherein the token entrance and the entryway are provided in an operating section of the housing and the token entrance is disposed adjacent to one end of the entryway.

5. The token-operated game machine as defined in claim 4, further comprising:

a token detection section which detects insertion of a token;

a supply section which supplies a token to the playing board or the playfield when the token detection section detects insertion of a token; and a token entry chute through which an inserted token passes to the supply section.

6. The token-operated game machine as defined in claim 4, wherein the token receiving section and the entryway are integrally provided in the operating section of the housing; and wherein the token entrance is disposed adjacent to one end of the entryway.

7. The token-operated game machine as defined in claim 4, wherein the token receiving section has a bowl-shaped configuration; and wherein a surface of the entryway on which a token is moved is on the same level with an inner surface of the token receiving section.

8. A token-operated game machine in which a token is inserted through a token entrance to drop a token from a playfield and pay out a token, the token-operated game machine comprising:

a token receiving section; and an entryway for slidably moving tokens from the token receiving section to the token entrance, wherein the token entrance and the entryway are provided in an operating section of the housing and the token entrance is disposed adjacent to one end of the entryway.

9. The token-operated game machine as defined in claim 8, further comprising a paying chute for sending a token dropped from the playfield to the token receiving section.

10. The token-operated game machine as defined in claim 9, wherein a dishonesty preventing section that prevents dishonesty by a player is provided in the paying chute.

11. The token-operated game machine as defined in claim 9, wherein the paying chute is connected to a token withdrawing chute; and wherein a switching section is provided for switching between a path from the paying chute to the token receiving section and a path from the paying chute to the token withdrawing chute.

12. The token-operated game machine as defined in claim 10, wherein the paying chute is connected to a token withdrawing chute; and wherein a switching section is provided for switching between a path from the paying chute to the token receiving section and a path from the paying chute to the token withdrawing chute.

13. The token-operated game machine as defined in claim 12, further comprising:

a token detection section which detects insertion of a token;

a supply section which supplies a token to the playing board or the playfield when the token detection section detects insertion of a token; and a token entry chute through which an inserted token passes to the supply section.

14. The token-operated game machine as defined in claim 8, further comprising:

a token detection section which detects insertion of a token;

a supply section which supplies a token to the playing board or the playfield when the token detection section detects insertion of a token; and a token chute through which an inserted token passes to the supply section.

15. The token-operated game machine as defined in claim 8, wherein the token receiving section and the entryway are integrally provided in the operating section of the housing; and wherein the token entrance is disposed adjacent to one end of the entryway.

16. The token-operated game machine as defined in claim 8, wherein the token receiving section has a bowl-shaped configuration; and wherein a surface of the entryway on which a token is moved is on the same level with an inner surface of the token receiving section.

* * * * *

UNITED STATES PATENT AND TRADEMARK OFFICE

CERTIFICATE OF CORRECTION

PATENT NO. : 7,017,904 B2
APPLICATION NO. : 10/880535
DATED : March 28, 2006
INVENTOR(S) : Toshiya Ohara et al.

It is certified that error appears in the above-identified patent and that said Letters Patent is hereby corrected as shown below:

On The Title Page Item

Add:

(30) Foreign Application Priority Data

November 9, 2001 (JP) ……...2001-345068

Signed and Sealed this

Twenty-second Day of August, 2006

JON W. DUDAS
*Director of the United States Patent and Trademark Office*